US006270626B1

(12) United States Patent
Hruschka

(10) Patent No.: US 6,270,626 B1
(45) Date of Patent: Aug. 7, 2001

(54) PAPER MAKING RETENTION SYSTEM OF BENTONITE AND A CATIONIC GALACTOMANNAN

(75) Inventor: Herbert Hruschka, Kreuzlingen (CH)

(73) Assignee: Rhodia Chimie, Boulogne Billancourt Cedex (FR)

( * ) Notice: Subject to any disclaimer, the term of this patent is extended or adjusted under 35 U.S.C. 154(b) by 0 days.

(21) Appl. No.: 09/674,318

(22) PCT Filed: Apr. 23, 1999

(86) PCT No.: PCT/FR99/00969

§ 371 Date: Feb. 9, 2001

§ 102(e) Date: Feb. 9, 2001

(87) PCT Pub. No.: WO99/55963

PCT Pub. Date: Nov. 4, 1999

(30) Foreign Application Priority Data

Apr. 27, 1998 (FR) ..... 98 05258

(51) Int. Cl.[7] ..... D21H 21/10

(52) U.S. Cl. ..... 162/178; 162/181.8; 162/183

(58) Field of Search ..... 162/175, 178, 162/181.8, 183

(56) References Cited

U.S. PATENT DOCUMENTS

| | | | |
|---|---|---|---|
| 4,305,781 | 12/1981 | Langley | 162/164 |
| 5,176,891 | 1/1993 | Rushmere | 423/328 |

FOREIGN PATENT DOCUMENTS

| | | | |
|---|---|---|---|
| 0 490 425 | 6/1992 | (EP) | D21H/17/68 |

*Primary Examiner*—Peter Chin
(74) *Attorney, Agent, or Firm*—Jean-Louis Seugnet

(57) ABSTRACT

The invention concerns a novel method for making paper based on sheet cellulose fibre, wherein a novel retention system comprising a suspension of bentonite and a cationic galactomannan is used to improve in particular the retention of the incorporated mineral fillers. The invention also concerns a method for making paper using a retention system which substantially improves draining.

14 Claims, No Drawings

PAPER MAKING RETENTION SYSTEM OF BENTONITE AND A CATIONIC GALACTOMANNAN

This application is an application under 35 U.S.C. Section 371 of International Application Number PCT/FR99/00969 filed on April 23, 1999.

The present invention relates to a novel process for making paper based on cellulose fibre in sheet form, in which a novel retention system comprising bentonite and a cationic galactomannan is used to improve in particular the retention of the mineral fillers incorporated. The present invention also relates to a process for making paper with the use of a retention system which substantially improves the draining, i.e. the speed with which water flows from the fibre suspension.

In addition, the mechanical properties of the paper obtained according to the process of the invention are improved, for example the rigidity and the tear strength, as well as other properties such as the whiteness. Furthermore, the retention system according to the invention can have advantages as regards the quality and recyclability of the white waters derived from the papermaking process, as well as of the papers broken during the manufacturing process.

Papermaking poses several problems. One of the overriding single concerns is to reduce the cost of paper by reducing the amount of cellulose fibres in the paper pulp composition. Another approach consists in reducing the concentration of waste water on account of the increasingly strict environmental constraints.

Papermakers have proposed various means to reduce the cost of papers and to try to improve their properties. One of the approaches used consists in adding inexpensive mineral fillers to the papermaking process to replace the fibre. Moreover, certain mineral fillers are specifically used to improve certain properties of paper. Thus, for example, titanium oxide is used in its anatase and/or rutile forms to improve the opacity of papers, in particular in the case of laminated papers.

Unfortunately, the addition of mineral fillers which are micrometre-sized particles comes up against the problem of retention: during the formation of the sheet on the paper machine wire, the mineral particles have a tendency to pass through this wire, which gives rise to charged white water circuits. This poses problems as regards the treatment of the broke as well as the sheet quality.

At the present time, the prior art proposes the use of retention agents to reduce the problem of the lack of retention. For example, EP 490 425 A1 proposes a twin system based on anionic inorganic particles and on a cationic carbohydrate polymer modified with aluminium, the cationic polymer being either a cationic starch or a cationic galactomannan.

However, many solutions proposed to date are not economically viable to allow their use for the preparation of any type of paper. The reason for this is that certain retention agents or retention systems, such as those containing a carbohydrate polymer modified with aluminium, are complex and expensive products, which thus does not allow them to be used for products of ordinary quality.

The Applicant has now developed a novel papermaking process using a novel retention system which considerably increases the retention of mineral fillers, fibres and other materials in the sheet of paper.

Another object of the invention is to propose a retention system and a papermaking process in which the properties of the paper obtained, including, for example, the opacity yield of the mineral fillers, the tear strength, the whiteness and other necessary properties, are improved, optimizing the use of mineral fillers. Needless to say, the optimization takes place as a function of the type of filler used.

Another object of the invention is to propose a paper with a high concentration of mineral fillers, which has an acceptable tear strength and other acceptable characteristics.

Another object of the invention is to propose an economically viable alternative retention system which does not require the use of complex and expensive products.

Other objects and advantages of the invention will emerge on reading the description below and in particular in the tests, tables and figures illustrating various characteristics of the invention.

The present invention is based on the development of a retention system and the papermaking process using it, which markedly improves the retention of mineral fillers and of other characteristics of paper and which optimises the action of the mineral fillers present in the paper pulp.

The increase in the retention of the mineral filler and fines in the context of our papermaking process attenuates the problems of contamination of the white waters.

The present invention thus relates to a process for making paper by forming and drying an aqueous paper pulp containing cellulose pulp and mineral fillers, in which a retention system comprising a cationic galactomannan containing at least two vicinal groups and a bentonite suspension is incorporated into the stock pulp before formation of the sheet.

The amount of solids in the retention system is generally from 0.02% to 5% by weight, preferably from 0.1 to 1% by weight, relative to the weight of the paper pulp or stock pulp.

The bentonite/galactomannan ratio should be between 1 and 10 by weight, and this ratio is preferably between 2 and 6, depending in particular on the degree of substitution of the galactomannan.

As regards the bentonite suspension, this is understood as being a bentonite suspension consisting of any type of commercial product referred to as bentonite or as bentonite-type clay, i.e. anionic swelling clays such as sepialite, attapulgite or, preferably, montmorillinite. By way of example, the bentonites described in U.S. Pat. No. 4,305,781 are suitable for use in the context of the invention.

The montmorillonite clays that are suitable include Wyoming bentonites and soapy earths. The clays may or may not be chemically modified, for example by alkaline treatment to exchange the calcium of bentonite for an alkali metal.

The swelling clays are usually metal silicates comprising a metal chosen from aluminium and magnesium, and optionally other metals, and the ratio of silicon atoms to metal atoms at the surface of the clay particles, and generally within their structure, is from 5/1 to 1/1. For most montmorillonites, the ratio is relatively low, the metal being essentially or totally aluminium, but with a small amount of magnesium and occasionally with, for example, a small amount of iron. However, in other swelling clays, all or some of the aluminium is replaced with magnesium and the ratio may be very low, for example about 1.5 for sepialite. The use of silicates in which some of the aluminium has been replaced with iron appears to be particularly desirable.

The aqueous suspension is generally prepared by dispersing the bentonite powder in water. The amount of bentonite contained in the said suspension is chosen such that the final weight percentage of bentonite relative to the weight of the paper pulp will be between about 0.1% and 5%. The viscosity of the bentonite suspension is generally less than 500 mPa.s (measured using a Brookfield viscometer at 100 rpm).

The size of the bentonite particles is preferably such that at least 90% are less than 100 microns, and preferably at least 60% are less than 50 microns (size of the dry particles). The surface area of the bentonite before swelling is preferably at least 30 $m^2/g$ and generally at least 50 $m^2/g$, typically 60 to 90 $m^2/g$, and the surface area after swelling is preferably from 400 to 800 $m^2/g$. The bentonite advantageously swells by at least 15 to 20-fold. The size of at least 90% of the particles after swelling is preferably less than 2 microns.

Commercial products which will be mentioned as non-limiting examples include the products Opazil AF and Opazil ADV from the company Sudchemie.

The cationic galactomannan according to the invention does not need to be modified with aluminium; it is preferably selected from galactomannans comprising at least two vicinal hydroxyl groups, in particular cationic guars. As regards the guars, it has been noted that their reactive centres are particularly accessible, which makes it possible to use only small amounts of them to achieve a satisfactory effect.

The base guar in the cationic guar is of natural type. The natural guar is extracted from the albumen of certain plant seeds, for example from *Cyamopsis Tetragonalobus*. The guar macromolecule consists of a linear main chain constructed from b-D-mannose monomer sugars linked together via (1–4) bonds, and a-D-galactose side units linked to the b-D-mannoses via (1–6) bonds.

The preparation of cationic guars is known per se. By way of example, cationic guars are formed by reaction between hydroxyl groups of polygalactomannan and reactive quaternary ammonium compounds.

The degree of substitution of the cationic groups of guar is generally at least 0.01, and preferably at least 0.05, and can be up to 1.0. In the context of the invention, a suitable range extends from 0.08 to 0.5. It is assumed that the molecular weight of guar gum ranges from 50,000 to 3,000,000, and is generally about 2,000,000.

When the retention system is used with cationic guar as one of the components, the mineral fillers are retained to a large degree in the final product and the paper produced is stronger than the paper obtained from a process without a retention system.

Commercial products which will be mentioned as non-limiting examples include the products from the series Meprobrond 110, Meprobond 9806, Meprobond 109, Jaguar C-13-S, Jaguar C-14-S, Jaguar C-15, Jaguar C-17 and Jaguar C-162 from the company Meyhall and from the company Rhodia Chimie, and the products Guar CAT 10 from the company Cesalpinia.

Depending on the case and/or on the nature of the galactomannans, the latter will be formulated in the form of aqueous solutions.

The mineral fillers used in the process are of varied nature and are chosen in particular as a function of the type of paper manufactured and its future use. The mineral filler material which can be used comprises any common mineral filler whose surface is of at least partially anionic nature.

Among the mineral fillers which will be mentioned as non-limiting illustrations are kaolin, clay, chalk, calcium carbonate, titanium dioxide and bentonite, and a mixture thereof.

The mineral fillers are normally added in the form of an aqueous dispersion at suitable concentrations that are appropriate for the type of paper manufactured.

Many commercial products can be used as mineral fillers for papermaking. Non-limiting examples which will be mentioned include the kaolin from the company ECC, the calcium carbonate Omyafill from the company Omya and Calopake from the company Rhodia Chimie, the titanium dioxide Finntitan from the company Kemira and Rhoditan from the company Rhodia Chimie.

The possibility of adding mineral fillers to the paper pulps is limited by factors such as the retention of the fillers on the wire, the dehydration of the paper pulp on the wire and the wet and dry strength of the paper obtained.

Now, in accordance with our invention, the problems mentioned above due to the addition of these fillers may be overcome or consequently eliminated by using our retention system, which also makes it possible to add higher than normal proportions of these fillers in order to obtain special properties in the paper produced.

Thus, using the retention system of the invention, it has become possible to produce a paper which contains more fillers while at the same time maintaining its mechanical properties. Hence, by means of this, the mechanical properties of the paper, including the modulus of elasticity, the tensile index, the absorption of tensile energy, etc. have values equal to or even greater than those achieved previously with papers obtained from conventional paper pulps in which a retention agent of the prior art is optionally used.

The sheet, after drying, has greatly improved strength characteristics when the process according to the invention is used. It has also been found that when mineral fillers such as those mentioned above and the like are used in the pulp, these mineral fillers are efficiently retained in the sheet and furthermore do not have an adverse effect on the strength of the sheet, unlike the sheets obtained by a manufacturing process without a gelling system according to the invention.

Although the mechanism which takes place within the stock pulp during the formation and drying of the paper in the presence of the retention system is not totally controlled, it is thought that the retention system forms a combination with the fibres and with the fillers to form a complex flocculent matrix.

Specifically, the manufacture of the sheet of paper necessarily proceeds via a draining step which can profoundly modify the structure of the colloids as well as their distribution. The changes in structure of the aggregates of fillers on draining affect the level of retention of these fillers as well as the opacity of the paper obtained. Thus, in the presence of the retention system of the invention, during draining, a flocculate is formed within the cellulose resin which imprisons the fillers to preserve the properties of the particles in suspension during this critical stage.

The components of the retention system are added to the papermaking device as a mixture or separately. However, according to a preferred embodiment variant of the invention, the optimum results are obtained when the retention system, based on bentonite and galactomannan, is formed in situ in the paper pulp.

This can be carried out advantageously by, in a first stage, adding galactomannan in the form of an aqueous solution and separately adding the aqueous bentonite solution to the pulp in a mixing tank or in a point in the device in which there is suitable stirring, such that the two components are dispersed with the components forming the paper and thus act simultaneously with each other and with the components for forming the paper.

It has been found that, in a papermaking process using the gelling system described in the invention, the pH of the stock pulp is not overly critical and is generally less than 11 and preferably between 5 and 9.

Other chemical additives of the paper can be mixed into the stock pulp, such as antifoams, bonding agents, etc. In this respect, it is important to ensure that the content of these other agents does not hinder the formation of the flocculent matrix, and that the content of agent(s) in the recycled white water does not increase too much up to a point where it would hinder the formation of the flocculent matrix. It will thus be preferable to add the agent(s) at a point in the system after the formation of the flocculent matrix.

The improvements due to the retention system are observed with an effect of the same magnitude both with chemical pulps and with mechanical and thermomechanical pulps.

From the research and studies carried out, it appears that the principles of the present invention can be applied to the manufacture of any type and quality of paper. Mention will be made, for example, of writing printing papers, wrapping papers and laminated papers.

Among the possibilities for preparing a paper type, writing printing paper is one of the routes which gives very positive results, i.e. increased retention of fillers and improved mechanical qualities of the paper. In this case, the filler used is mainly calcium carbonate.

The amount of retention system to be used varies according to the desired effect and the characteristics of the particular components which are chosen in the preparation of the said system. For example, for a bentonite with given characteristics in a retention system, if this system contains cationic guar gum with a D.S. of 0.03 instead of a D.S. of 0.07, more retention system will be needed.

The examples and laboratory tests below illustrate, in a non-limiting manner, advantages and properties associated with the use of the retention system according to the invention for the preparation of paper. Good results are obtained with the retention system according to the invention, although the galactomannan is not modified with aluminium.

The use of the retention system according to the present invention is compared in particular with the uses of guar alone, of a bentonite+starch system and of a bentonite+polyacrylamide system.

Tests

The retention performance qualities are measured essentially by two parameters:

- the retention: amount of fillers retained on the sheet of paper, or for the total retention, total amount of fine particles retained on the sheet,
- the draining: which characterizes the speed with which water flows from the fibrous suspension.

These two characteristics can be measured by means of various methods:

- "BRITT Jar" method: this measures the chemical retention (total and fillers),
- "Shopper-Riegler" method: this measures the chemical retention and the draining.

Other parameters can be measured by the following methods:

- "Rapid Köthen" method: this gives a measurement relative to the formation of the sheet (DIN standard 54358).
- Measurement of the tear strength using the "Lloyd 500 Strength Tester" machine.

So-called "Britt Jar" method

This method consists in measuring the chemical retention of the fillers while avoiding the formation of the fibrous wad which is responsible for mechanical retention by means of a filtration effect. In the context of our tests, the dissolved cationic guar is added, in a first stage, to 1000 ml of the fibre dispersion kept stirring at 500 rpm, followed by the addition, in a second stage, of the bentonite suspension. The first 200 ml are then removed through a screen. By determining the respective amounts of fibres and fillers which have passed into the filtrate, the overall (fibres+fillers) retention values and filler retention values are obtained by calculation.

This method of measuring the retention is described by K. Britt and J. E. Unbehend in Research Report 75, 1/10 1981, published by Empire State Paper Research Institute ESPRA, Syracuse, N.Y. 13210, USA.

For the measurements, a filtration jar equipped with a 125 P aperture grille with an aperture size of 75 $\mu$m was used.

So-called "Shopper-Riegler" method

This Shopper-Riegler method is used according to NFQ standard 50-003.

The cationic guar used has a D.S. equal to 0.1 and the bentonite used is the product Opazil from the company Sud Chemie.

EXAMPLE 1

Retention

This example shows the chemical retention btained by applying the Britt Jar test.

Different formulations with variable percentages of cationic guar and bentonite were prepared (see Table 1 below). The percentages are given on a weight basis relative to the weight of the paper pulp.

i) Preparation of the stock suspension and dilution

The fibre mixture consists of 60% by weight of Eucalyptus chemical pulp and 40% by weight of sulphated long-fibre chemical pulp. This mixture is obtained by refining in a Rieth Hollander machine up to 24 SR in order to obtain a pulp with a density of 3%. This pulp is then diluted to 0.5% with a pH of about 7.

Before diluting the pulp, 40% by weight of $CaCO_3$ as filler and 3% by weight of polyaluminium chloride are added to this mixture with stirring. The stirring is maintained throughout the operations so as to ensure ideal homogeneity when samples are taken.

ii) Britt Jar test 1000 ml of the suspension mixture prepared are taken. These 1000 ml are introduced into the Britt Jar with stirring using a helical-type paddle and fitted with a 125 P 75 $\mu$m grille.

The stirring speed is about 500 rpm.

The guar is added, followed by stirring for 60 seconds. Bentonite is then introduced (in the tests comprising this product). Stirring is then carried out for 15 seconds.

200 ml of the mixture are removed by gravity.

iii) Filtration

The 200 ml removed are then filtered through a Büchner funnel with Whatmann No. 42 filters (ashless filters predried for 1 h at 105° C. and then weighed to±0.0001 g).

The filtration residue is then removed carefully, dried for 1 hour at 105° C. and then cooled in a desiccator and weighed (±0.0001). This allows calculation of the overall degree of retention.

The residue thus dried on a filter is then calcined (according to the NFQ Ash Content standard No. 03-047) to give the degree of retention of fillers for the mixture.

iv) Calculations and results

The overall retention is calculated using the following formula:

$$\text{Overall retention} = \frac{(W1 - W2)}{W1} \times 100$$

W1=Weight of the mixture (fillers+fibres) in the initial sample removed.

W2=Weight of the residue from the filtered and dried 200 ml sample.

The results are given in Table 1.

TABLE 1

| Formulations | % of guar | % of bentonite | % Increase in retention of fillers |
|---|---|---|---|
| A | 0.05 | 0 | 10 |
| B | 0.075 | 0 | 15 |
| C | 0.1 | 0 | 21 |
| D | 0.2 | 0 | 27 |
| A' | 0.05 | 0.25 | 29 |
| B' | 0.075 | 0.25 | 31 |
| C' | 0.1 | 0.25 | 33 |
| D' | 0.2 | 0.25 | 35 |

EXAMPLE 2

Draining

This example shows the draining calculated according to the modified Shopper-Riegler method.

Different formulations with variable percentages of cationic guar and bentonite were prepared (see Table 2 below). The percentages are given on a weight basis relative to the weight of the paper pulp.

i) Modified Shopper-Riegler test

The suspension of fibre mixture used is identical to that in Example 1.

The guar and bentonite are added and mixed in the Britt Jar containing 1000 ml of the suspension mixture prepared in an identical manner to that of Example 1.

The 1000 ml are then transferred into the tank of the Shopper-Riegler machine. The time required to drain 600 ml of solution is calculated.

ii) Calculations and results

The time measured in seconds is that of the degree of draining.

For the results, see Table 2.

TABLE 2

| Formulations | % of guar | % of bentonite | % Increase in % Increase in draining |
|---|---|---|---|
| A | 0.05 | 0 | −4 |
| B | 0.075 | 0 | −8 |
| C | 0.1 | 0 | −8 |
| D | 0.2 | 0 | −5 |
| A' | 0.05 | 0.25 | 8 |
| B' | 0.075 | 0.25 | 16 |
| C' | 0.1 | 0.25 | 23 |
| D' | 0.2 | 0.25 | 36 |

EXAMPLE 3

Comparison with Polyacrylamide and Cationic Starch i) Composition of the stock suspension and dilution:

The fibre suspension is a mixture containing 30% long fibres, 30% short fibres, 30% coated broke and 10% $CaCO_3$, and its pH is 7. This mixture is obtained from a high-density (3.5%) system of a paper machine.

ii) Products used:

0.075% cationic guar of D.S.=0.1 (Meprobond 9806).

0.050% of high molecular weight polyacrylamide (Percoll 292 from the company Allied Colloids).

0.500% of cationic starch of D.S.=0.045 (Hicat from the company Roquette).

0.300% of bentonite (Opazil).

iii) The order of addition of the products is identical to that in Example 1.

iv) The measuring methods are identical to those of Examples 1 and 2 (Britt Jar and Shopper-Riegler). In addition, the tear strength is measured.

v) Results: see Table 3.

TABLE 3

| % Change | Guar | Guar + bentonite | Polyacrylamide + bentonite | Cationic starch + bentonite |
|---|---|---|---|---|
| Retention | +31 | +58 | +62 | +46 |
| Draining | −10 | +33 | +35 | 25 |
| Tear strength | +10 | +13 | +2 | +15 |

What is claimed is:

1. A process for making a sheet of paper from a stock pulp by forming and drying an aqueous paper pulp containing cellulose pulp and mineral fillers, comprising the step of incorporating a retention system comprising (i) a cationic galactomannan containing at least two vicinal hydroxyl groups and not modified with aluminum, and (ii) a bentonite suspension into the stock pulp before formation of the sheet.

2. A process according to claim 1, wherein the retention system has an amount of solids of from 0.1% to 5% by weight, relative to the weight of the paper pulp.

3. A process according to claim 1, wherein the galactomannan has a degree of substitution of at least 0.01.

4. A process according to claim 3, wherein the galactomannan has a degree of substitution of at least 0.05.

5. A process according to claim 4, wherein the galactomannan has a degree of substitution of up to 1.0.

6. A process according to claim 1, wherein the mineral fillers are clay, chalk, calcium carbonate, titanium oxide, or bentonite.

7. A process according to claim 1, wherein the stock pulp has a pH maintained between 5 and 9.

8. A process according to claim 1, wherein the retention system has a solid content of from 0.02% to 5% by weight, relative to the weight of the stock pulp.

9. A process according to claim 1, wherein the retention system presents a bentonite/galactomannan ratio between 1 and 10 by weight.

10. A process according to claim 9, wherein the bentonite/galactomannan ratio is between 2 and 6.

11. A process according to claim 1, wherein the retention system is formed in situ in the paper pulp.

12. A process according to claim 1, wherein the retention system is formed in situ in the paper pulp.

13. A process according to claim 11, wherein the retention system is formed in situ by adding, in a first stage, galactomannan in the form of an aqueous solution and adding, in a second stage, aqueous bentonite solution to the paper pulp in a mixing tank or at a point in the device in which there is stirring.

14. Laminated paper, writing printing paper or wrapping paper made by the process of claim 1.

* * * * *